US006808134B2

(12) United States Patent
Noller et al.

(10) Patent No.: US 6,808,134 B2
(45) Date of Patent: Oct. 26, 2004

(54) FUEL INJECTION VALVE

(75) Inventors: Klaus Noller, Oppenweiler (DE); Uwe Liskow, Pleidelsheim (DE); Martin Buehner, Backnang (DE); Guido Pilgram, Schwieberdingen (DE); Juergen Maier, Ottmarsheim (DE); Hartmut Albrodt, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 160 days.

(21) Appl. No.: 10/110,184

(22) PCT Filed: Jul. 20, 2001

(86) PCT No.: PCT/DE01/02765

§ 371 (c)(1),
(2), (4) Date: Aug. 19, 2002

(87) PCT Pub. No.: WO02/12709

PCT Pub. Date: Jul. 20, 2001

(65) Prior Publication Data

US 2003/0047160 A1 Mar. 13, 2003

(30) Foreign Application Priority Data

Aug. 10, 2000 (DE) ..... 100 39 078

(51) Int. Cl.[7] ..... B05B 1/30

(52) U.S. Cl. ..... 239/585.1; 239/533.2; 251/129.15; 251/129.19; 251/129.21; 335/257; 335/277

(58) Field of Search ..... 239/585.1–585.5, 239/533.2–533.12; 251/129.15, 129.19, 129.21; 335/257, 277

(56) References Cited

U.S. PATENT DOCUMENTS 5,299,776 A * 4/1994 Brinn et al. ..... 251/77
6,170,757 B1 * 1/2001 Herrmann et al. ..... 239/88
6,367,769 B1 * 4/2002 Reiter ..... 251/129.19

* cited by examiner

*Primary Examiner*—Dinh Q. Nguyen
(74) *Attorney, Agent, or Firm*—Kenyon & Kenyon

(57) ABSTRACT

A fuel injector, particularly a fuel injector for fuel injection systems in internal combustion engines, has a valve needle, which cooperates with a valve-seat surface to form a sealing seat, and an armature, which engages with the valve needle, the armature being movable along the axis of the valve needle and being damped by a damping element made from an elastomer. In this context, a first intermediate ring is situated between the armature and the damping element. The damping element rests on the flange, which is connected in a force-locking manner to the valve needle. The intermediate ring and/or the flange is furnished with radial and/or axial channels which connect an interior volume located between the valve needle and the damping element to a central cutaway of the fuel injector.

10 Claims, 2 Drawing Sheets

FUEL INJECTION VALVE

FIELD OF THE INVENTION

The present invention relates to a fuel injector.

BACKGROUND INFORMATION

A fuel injector having a valve-closure member which is attached to a valve needle and which cooperates with a valve-seat surface formed on a valve seat member to form a sealing seat is described in U.S. Pat. No. 4,766,405. Electromagnetic actuation of the fuel injector is provided by a magnetic coil, which cooperates with an armature which is connected in a force-locking manner to the valve needle. An additional cylinder-shaped ground is arranged around the armature and the valve needle, and is connected to the armature via an elastomer film.

The disadvantage of this arrangement is particularly the complicated construction, requiring an additional component. The large-surface elastomer ring also interferes with the shape of the magnetic field and makes closure of the electric flux lines difficult, so that it is also impossible to achieve high starting forces in the opening movement of the fuel injector.

Another embodiment is described in U.S. Pat. No. 4,766,405 in which an additional cylindrical ground is provided around the valve needle and the armature for damping and debouncing, and which is movably secured in position by two elastomer rings. When the valve needle comes into contact with the sealing seat, this second ground is able to move relative to the armature and valve needle, thus preventing bouncing.

The disadvantage of this embodiment is the additional complexity and space requirement. Moreover, the armature itself is not decoupled, and the impulse therefrom increases the tendency of the valve needle to bounce.

A fuel injector is described in U.S. Pat. No. 5,299,776 having a valve needle and an armature, in which the armature is movably guided on the valve needle, and whose movement in the direction of the valve needle's lift is limited by a first stop, and in the opposite direction by a second stop. The axial travel of the armature thus defined by the two stops causes decoupling to a limited extent of the valve needle's inert mass from the armature's inert mass. This in some degree counteracts the tendency of the valve needle to rebound from the valve-seat surface when the fuel injector closes. However, since the axial position of the armature relative to the valve needle is entirely undefined because of the armature's free mobility relative to the valve needle, bouncing is only prevented to a limited degree. In particular, the fuel injector construction described in U.S. Pat. No. 5,299,776 does not prevent the armature from coming into contact with the stop facing the valve-closure member when the fuel injector closes, and thereby abruptly transferring an impulse to the valve needle. This abrupt impulse may cause additional bouncing of the valve-closure member.

It is also known from actual operation to use an elastomer ring to movably fasten in position the armature which is movably arranged on the valve needle. For this purpose, the armature is restrained between two stops, an elastomer ring being arranged between the armature and the bottom stop. However, this presents the problem that a hole must be provided through the armature to allow the fuel to reach the valve-seat surface. The hole through the armature is provided close to the valve needle.

SUMMARY OF THE INVENTION

The fuel injector according to the present invention has the advantage over the related art due to the fact that, by their position and structure, the intermediate rings situated between the armature and the damping element, and/or between the damping element and the flange assure balanced pressure conditions, so that the damping element remains securely in place and cannot be damaged by slipping. The radially and/or axially extending channels assure fluid equalization between an interior volume delimited by the valve needle, the armature, and the damping element on the one hand and a central cutaway in the fuel injector on the other. Fluid equalization provides additional damping according to the principle of a shock absorber.

In addition, the damping element is supported by the intermediate rings, thereby preventing the elastomer ring from vibrating.

The drainage holes in the flange may be produced simply and drain the fuel between damping element and valve needle away rapidly and without turbulence.

The intermediate rings are advantageously furnished with grooves that extend radially outward, e.g., in the form of an embossed structure, so that the fuel on the lower and upper side of the damping element may also be removed. In this way, not only is an overpressure and thereby lateral slippage of the damping element avoided, but also the bouncing behavior of armature and valve needle is positively influenced, since the viscosity of the fuel enhances the damping effect, and thus counteracts the bouncing.

The gap between valve needle and armature may be drained in a particularly simple manner by segment welding in such manner that the valve needle is joined to the flange not by an uninterrupted weld seam, but by spot welding, whereby sections of attachment alternate with passages through which the fuel may flow.

A combination of the individual drainage devices is particularly advantageous, so that for example the flange may be connected to the valve needle by segment welding and the damping element has intermediate rings on the inlet and the outlet sides.

DETAILED DESCRIPTION

Figure 1:
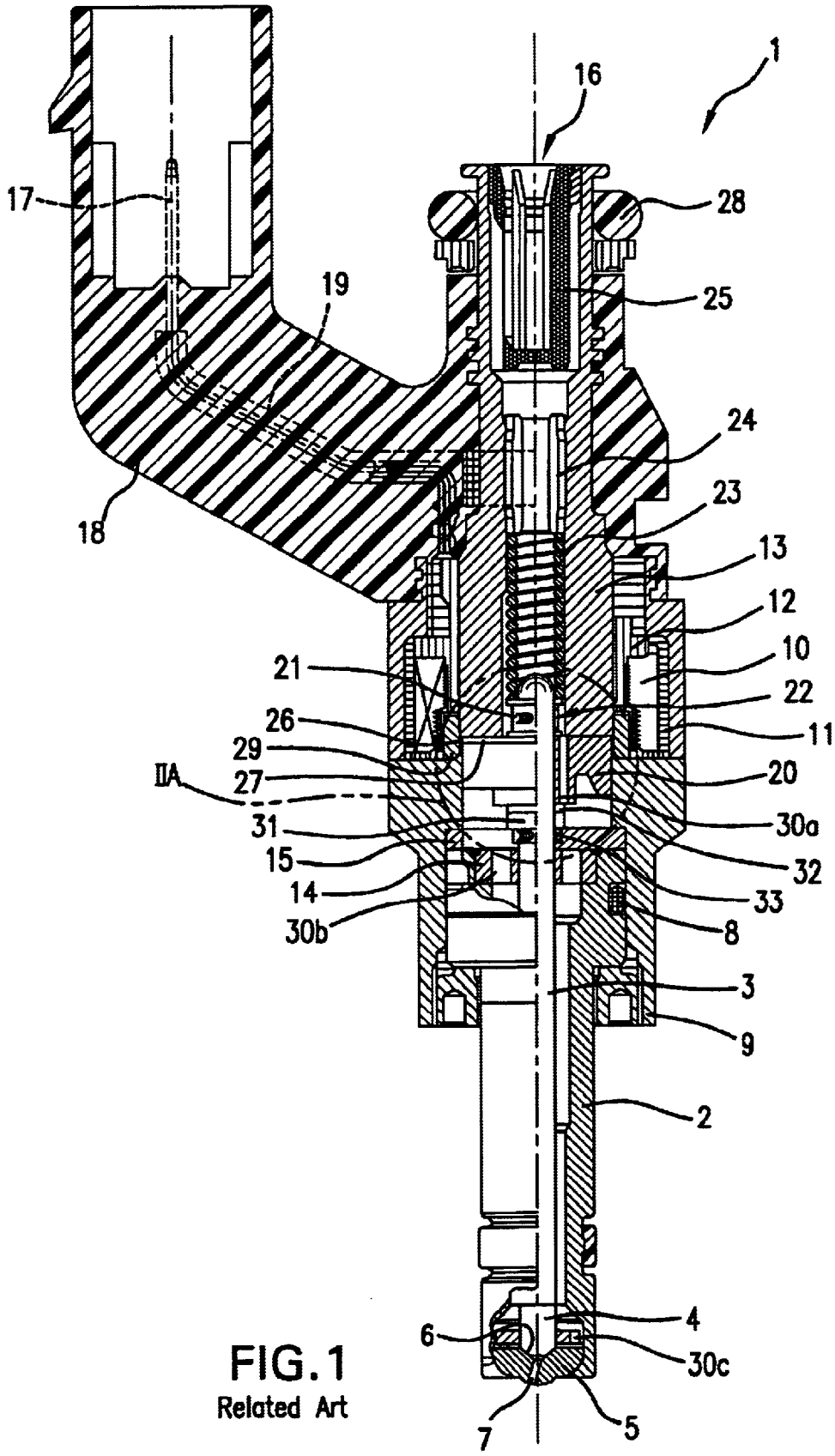
FIG. 1 Related Art
FIG. 1 shows a schematic section through an embodiment of a fuel injector according to the related art.
Figure 2A:
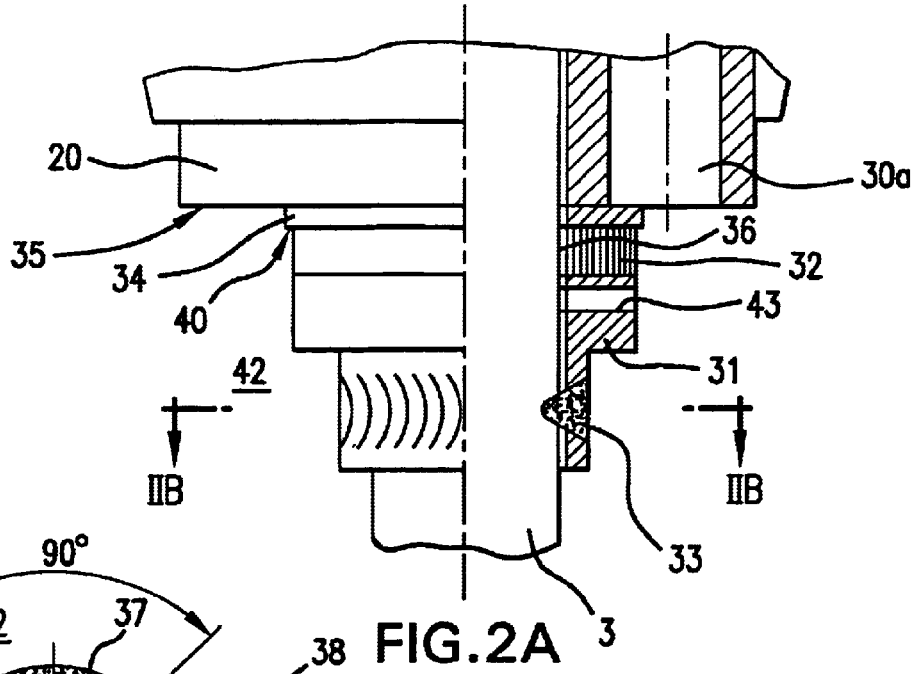
FIG. 2A shows a schematic longitudinal section through a fuel injector according to the present invention in the area designated IIA in FIG. 1.
Figure 2B:
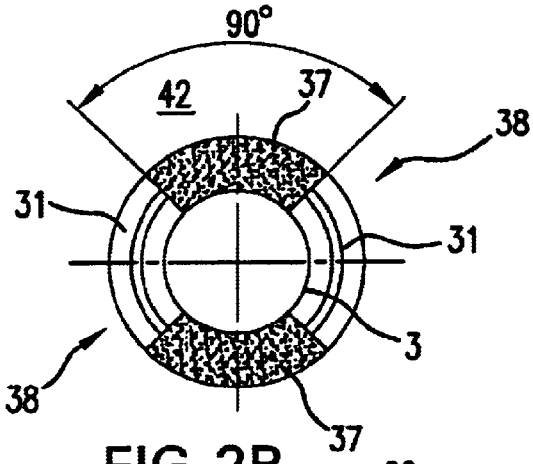
FIG. 2B shows a schematic section along line IIB—IIB in FIG. 2A.
Figure 3:
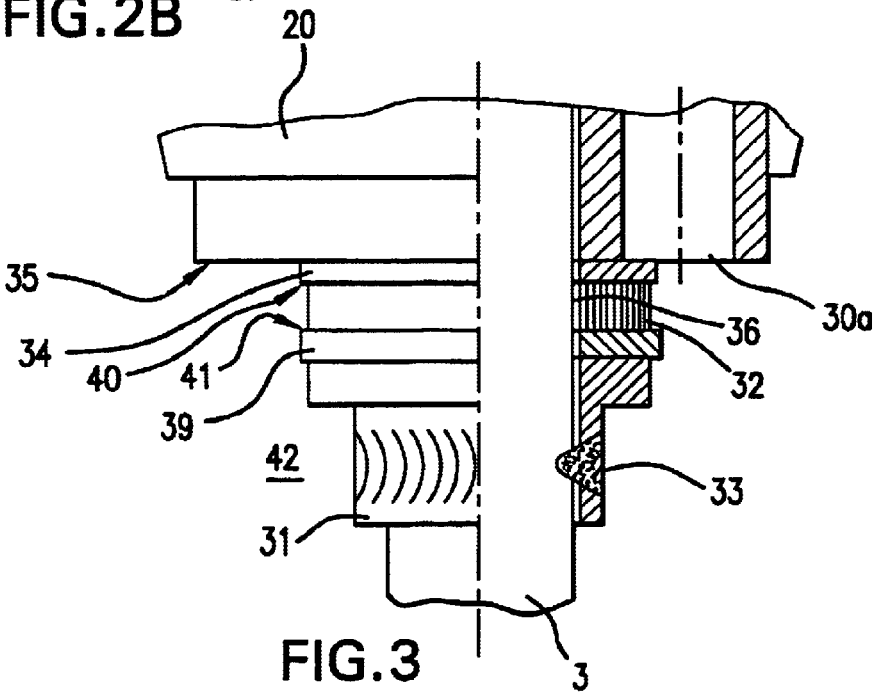
FIG. 3 shows a schematic longitudinal section through another embodiment of a fuel injector according to the present invention in the area designated IIA in FIG. 1.

Before proceeding with a detailed description of fuel injector 1 according to the present invention with reference to FIGS. 2A, 2B and 3, a better understanding of the present invention will be served by a short explanation with reference to FIG. 1 of the prominent components of a known fuel injector 1 which is identical in its construction to the embodiments with the exception of the inventive measures of the present invention.

Fuel injector 1 is designed in the form of a fuel injector for fuel injection systems of mixture compressing, externally ignited internal combustion engines. Fuel injector 1 is particularly suited for direct injection of fuel into a combustion chamber (not shown) of an internal combustion engine.

Fuel injector 1 is made up of a nozzle body 2 in which a valve needle 3 is guided. Valve needle 3 is linked in a force-locking manner with valve-closure member 4, which cooperates with valve-seat surface 6 arranged on valve seat body 5 to form a sealing seat. In the embodiment, fuel injector 1 is an inwardly opening fuel injector 1, having an injection orifice 7. Nozzle body 2 is sealed off from external pole 9 of magnet coil 10 by seal 8. Magnet coil 10 is contained in coil housing 11 and wound around insulating frame 12, which is in contact with an internal pole 13 of magnet coil 10. Internal pole 13 and external pole 9 are isolated from one another by a constriction 26 and connected with one another by a non-ferromagnetic connecting component 29. Magnet coil 10 is excited by an electrical current which may be supplied via line 19 via electrical contact plug 17. Contact plug 17 is enclosed by plastic casing 18, which may be sprayed on internal pole 13.

Valve needle 3 is seated in valve needle guide 14, which is disk-shaped. Matched adjusting disk 15 is used for lift adjustment. On the other side of adjusting disk 15 is armature 20. This is connected in a force-locking manner with valve needle 3 via first flange 21, valve needle 3 being connected to first flange 21 by welded seam 22. A first flange 21 supports a restoring spring 23, which in this design of fuel injector 1 is pre-tensioned by sleeve 24. Fuel channels 30*a* to 30*c* are arranged in valve needle guide 14, in armature 20, and on valve seat body 5. These channels supply the fuel, which is fed via central fuel supply 16 and filtered through filter element 25, to injection orifice 7. Fuel injector 1 is sealed off from a fuel line (not shown) by seal 28.

An annular damping element 32, made from an elastomer substance, is arranged on the injection side of armature 20. It is supported by second flange 31, which is connected non-positively to valve needle 3 via weld seam 33.

When the component including armature 20 and valve needle 3 is manufactured, first flange 21 is welded to valve needle 3, armature 20 and damping element 32 are placed on top and then second flange 31 is pressed onto damping element 32 and is also welded to valve needle 3. In this manner, armature 20 is given restricted, highly damped play between first flange 21 and damping element 32.

In the rest position of fuel injector 1, armature 20 is forced against its lift direction by restoring spring 23, so that valve-closure member 4 is held in a sealing position on valve seat 6. When magnet coil 10 is excited, it creates a magnetic field that moves armature 20 against the elastic force of restoring spring 23 in the direction of the lift, the lift being predetermined by working gap 27 which is located between internal pole 12 and armature 20 in the rest position. Armature 20 also moves flange 21, which is welded to valve needle 3, in the direction of the lift. Valve-closure member 4, which is linked in a force-locking manner to valve needle 3, lifts off from valve-seat surface 6 and the fuel that is fed through fuel channels 30*a* to 30*c* is injected through injection orifice 7.

When the coil current is switched off, armature 20 drops away from internal pole 13 under the pressure of restoring spring 23 when the magnetic field has been sufficiently reduced, so that flange 21 which is linked in a force-locking manner to valve needle 3 moves against the direction of the lift. Valve needle 3 is thereby moved in the same direction, so that valve-closure member 4 comes to rest on valve-seat surface 6 and fuel injector 1 is closed.

FIG. 2A shows in a partial cutaway section an enlarged view of t he area indicated in FIG. 1 by IIA.

FIG. 2A shows a portion of valve needle 3, second flange 31, which is welded thereto, and the bottom part of armature 20, with fuel channel 30*a* therein. Damping element 32 is situated on top of second flange 31. The embodiment according to the present invention shown in FIG. 2A has a first intermediate ring 34, which is arranged between armature surface 35 on the outlet side and damping element 32.

First intermediate ring 34 performs a dual task: in the first place, it protects damping element 32 from the striking motion of armature 20, since particularly the edges of fuel channel 30*a* may damage damping element 32 during prolonged operation of fuel injector 1, so that correct functioning of fuel injector 1 could no longer be assured.

In the second place, with an appropriate surface structure, first intermediate ring 34 also assures drainage of interior volume 36 between damping element 32 and valve needle 3, which is penetrated by fuel while fuel injector 1 is operating. The surface structure of first intermediate ring 34 thus provides a connection between interior volume 36 and a central cutaway 42 of fuel injector 1.

If the fuel that flows into interior volume 36 during operation of fuel injector 1, and which is compressed by the relative movement between valve needle 3 and armature 20, cannot be removed from interior volume 36, damping element 32 may be subjected to lateral displacements, which in turn causes damage to damping element 32 as a consequence of undesirable stretching and stress concentration or turbulence in the fuel flow.

However, as shown in FIG. 2B in a radial section view along line IIB—IIB in FIG. 2A, the fuel compressed in interior volume 36 may also be drained not radially, but axially in the direction of the outflow. To this end, second flange 31 is secured by segment welding to valve needle 3. This means that second flange 31 is not connected to valve needle 3 by a solid circumferential weld seam 33, but by individual weld segments 37 which, as shown in FIG. 2B, have a radial angular range of for example 90° and encompass two drainage gaps 38, which also have an angular range of about 90°. The fuel compressed in interior volume 36 can thus flow out through drainage gaps 38 between valve needle 3 and second flange 31.

The technique of segment welding particularly has the advantage that it allows the compressed fuel to be drained off easily from interior volume 36 without the need for additional components.

In order to connect second flange 31 to valve needle 3, it is also possible to apply not only two weld segments 37, but also, for example, four weld segments 37 facing each other in a cross arrangement, and with four corresponding drainage gaps 38. The number of weld segments 37 and drainage gaps 38 may be changed to meet specific requirements.

FIG. 3 shows in a partial cutaway section another embodiment of fuel injector 1 according to the present invention. In this case, a second intermediate ring 39 is interposed between second flange 31 and damping element 32.

For the purpose of removing the fuel compressed in interior volume 36, radial grooves may be expediently applied to an outlet side 40 of first intermediate ring 34 and to an inlet side 41 of second intermediate ring 39; along these grooves the fuel can flow from interior volume 36 between first intermediate ring 34 and second intermediate ring 39 on the surface of damping element 32. The structure of outlet side 40 of first intermediate ring 34 and of inlet side 41 of second intermediate ring 39 may be created by, for example, embossing or milling.

Another option for removing the fuel trapped in interior volume 36 is to drill radial holes 43 in second flange 31, which would form a connection between interior volume 36 and central cutaway 42 in fuel injector 1, for example, just below damping element 32. The number of holes may be as few as one, but a number of holes 43 may be provided, e.g., at regular angular intervals.

A common feature of all the embodiments according to the present invention of a fuel injector 1 described in the foregoing is that with appropriate selection of the diameter of holes 43, drainage gaps 38 or groove arrangement, the ratio of the quantity of fuel flowing out of and into internal volume 36 may be controlled. The damping resulting therefrom may be used to prevent bouncing.

These measures particularly inhibit bouncing of the valve needle, since when valve-closure member 4 is in position, valve needle 3 encounters resistance due to the viscosity of the fuel in interior volume 36, and is therefore no longer able to move back in the lift direction.

The present invention is not limited to the embodiments shown, but is also suitable, for example, for use in outwardly opening fuel injectors 1 or for other armature types, such as flat armatures.

What is claimed is:

1. A fuel injector, comprising:

a valve-seat surface;

a valve needle that cooperates with the valve-seat surface to form a sealing seat;

a flange connected in a force-locking manner to the valve needle;

a damping element made from an elastomer and resting on the flange;

an armature that engages with the valve needle and that is axially movable on the valve needle, the armature being damped by the damping element; and a first intermediate ring situated between the armature and the damping element, wherein:

at least one of the first intermediate ring and the flange includes at least one of at least one radial channel and at least one axial channel that connects an interior volume situated between the valve needle and the damping element to a central cutaway of the fuel injector.

2. The fuel injector according to claim 1, wherein:

the fuel injector is for a fuel injection system in an internal combustion engine.

3. The fuel injector according to claim 1, further comprising:

a second intermediate ring situated between the damping element and the flange.

4. The fuel injector according to claim 3, wherein:

the second intermediate ring includes at least one channel for connecting the interior volume to the central cutaway of the fuel injector.

5. The fuel injector according to claim 4, wherein:

the at least one channel of the second intermediate ring is configured as a radial groove on an inflow side of the second intermediate ring.

6. The fuel injector according to claim 1, wherein:

the at least one of the at least one radial channel and the at least one axial channel is configured as a radial bore hole in the flange.

7. The fuel injector according to claim 1, wherein:

the at least one of the at least one radial channel and the at least one axial channel is configured as a radial groove on an outflow side of the first intermediate ring.

8. The fuel injector according to claim 1, wherein:

the flange is secured to the valve needle by segment welding.

9. The fuel injector according to claim 8, wherein:

the flange is connected to the valve needle via at least two welded segments, and the at least two welded segments have a radial angular extent of about 90°.

10. The fuel injector according to claim 9, wherein:

drainage gaps are formed between the at least two welded segments.

* * * * *